US010016323B2

(12) United States Patent
Hall et al.

(10) Patent No.: US 10,016,323 B2
(45) Date of Patent: Jul. 10, 2018

(54) WHEELCHAIR INJURY-PREVENTION GUARD

(71) Applicants: Steven Ronald Hall, Sturbridge, MA (US); Janet Claire Hall, Sturbridge, MA (US)

(72) Inventors: Steven Ronald Hall, Sturbridge, MA (US); Janet Claire Hall, Sturbridge, MA (US)

( * ) Notice: Subject to any disclaimer, the term of this patent is extended or adjusted under 35 U.S.C. 154(b) by 0 days.

(21) Appl. No.: 15/296,060

(22) Filed: Oct. 18, 2016

(65) Prior Publication Data

US 2018/0104121 A1 Apr. 19, 2018

(51) Int. Cl.
*A61G 5/12* (2006.01)

(52) U.S. Cl.
CPC ..... *A61G 5/127* (2016.11); *A61G 2203/70* (2013.01); *A61G 2203/723* (2013.01)

(58) Field of Classification Search
CPC ..... A61G 5/127; A61G 5/128; A61G 5/1043; A61G 2203/723
See application file for complete search history.

(56) References Cited

U.S. PATENT DOCUMENTS

| | | | | |
|---|---|---|---|---|
| 8,403,420 | B2 * | 3/2013 | Billescas | A61G 5/128 280/250.1 |
| 9,132,050 | B1 * | 9/2015 | Hector, Jr. | A61G 5/1043 |
| 2004/0075327 | A1 * | 4/2004 | Adams | A61G 5/12 297/423.4 |
| 2013/0112827 | A1 * | 5/2013 | Holstad | A61G 5/10 248/229.2 |
| 2016/0331608 | A1 * | 11/2016 | Thomas | A61G 5/10 |

* cited by examiner

*Primary Examiner* — Kevin Hurley

(57) ABSTRACT

A collar with a relieved area (3) strategically placed in-between the upper and lower wheelchair leg-rest attachments (2) so a leg-rest can still be removed and installed and where the leg-rest locking arm (6) can lock into place unimpeded. A second collar (4) attached directly below the lower wheelchair leg-rest attachment (2). Both collars (3 and 4) are locked into place using flat-head screws (5). Collars (3 and 4) are of sufficient size to extend horizontally beyond the typically exposed mainframe leg-rest attachments (2). When installed at both leg-rest attachment areas (2) the invention protects a wheelchair user from a laceration injury.

1 Claim, 5 Drawing Sheets

WHEELCHAIR INJURY-PREVENTION GUARD

CROSS REFERENCE TO RELATED APPLICATIONS

Not Applicable

FEDERAL SPONSORED RESEARCH

Not Applicable

SEQUENCE LISTING OR PROGRAM

Not Applicable

BACKGROUND OF INVENTION

Field of Invention

This invention relates to a specific wheelchair design feature or accessory device that helps to guard against injury usually caused from the footrest attachment area on a wheelchair.

Background of Invention

Manual wheelchairs are designed with an area below the seat and above the front wheels where removable footrests attach to the wheelchair. It is important that these footrests be removable for a number of reasons including, but not limited to: entry and exit from said wheelchair: to allow for an occupant confined to a wheelchair to move around independently using his/her feet for locomotion; for a caregiver or healthcare professional to assist or examine a occupant: and/or allow an occupant confined to a wheelchair to sit at a dining or other table. Likewise, it is important that these footrests be attachable for a number of reasons including, but not limited to: for occupant's comfort; for health related conditions requiring elevation of legs; and/or for safe transporting of occupant by a caregiver or family member.

Unfortunately, the area where the leg-rests attach to the wheelchair can be harmful to an occupant when the leg-rests are not attached. More specifically, the wheelchair leg-rest attachment area is designed in such a way that there is a metal area that protrudes out and away from the wheelchair frame that poses a risk of injury, including risk of severe laceration, to the occupant—especially for the occupant whose skin is frail from advanced age or disease.

U.S. Pat. No. 8,122,925 to Lane et al. attempts to solve this risk by the use of one padded cover that attaches to each side of a manual wheelchair at the leg-rest area with Velcro closures. U.S. Pat. No. 9,132,050 to Hector, Jr. et al. does something similar where each of the four protruding areas are covered up with a padded wrap.

With consideration that it is often necessary to attach and remove leg-rests multiple times a day, both of these inventions are limiting because the covers must be removed in order to attach the leg-rest and later re-attached when the leg-rest is removed. This requirement leaves open the possibility that a caregiver could fail to attach this invention after removing a leg-rest, which could lead to serious injury of a frail occupant. Patent Moreover, the caregiver could easily misplace or loose the protective cover when the leg-rests are attached (and this invention is not attached to the wheelchair).

BACKGROUND OF INVENTION

Objects and Advantages

Accordingly, several objects and advantages of our patent are:

(a) to provide injury protection without the need to remove or attach any device to cover up the leg-rest attachment area;

(b) to provide a permanent means to prevent injury in relation to the leg-rest attachment area;

(c) to allow the removal and attachment of a wheelchair leg-rest without impeding its operation and without the need to remove or attach a protective device;

(d) to provide a more sanitary guard;

Further objects and advantages of our invention will become apparent from a consideration of the drawings and ensuing description.

SUMMARY

The invention portrayed is a means to protect a wheelchair user from coming in contact with the leg-rest attachment area on the main-frame area of a manual wheelchair. The invention can be incorporated during manufacture of a wheelchair or as an accessory attached to a wheelchair. It consists of one or more devices that are attached to the main-frame in the area of the leg-rest attachment area that are larger than the protruding area of the leg-rest attachment area. With our invention in place, the wheelchair user's leg makes contact with our invention first, thus preventing injury that could have occurred from the protruding area of the leg-rest attachment area of a wheelchair. The wheelchair leg-rests are still able to be removed or attached with the invention in place.

DRAWINGS

DRAWINGS

Reference Numerals

Figure 1:
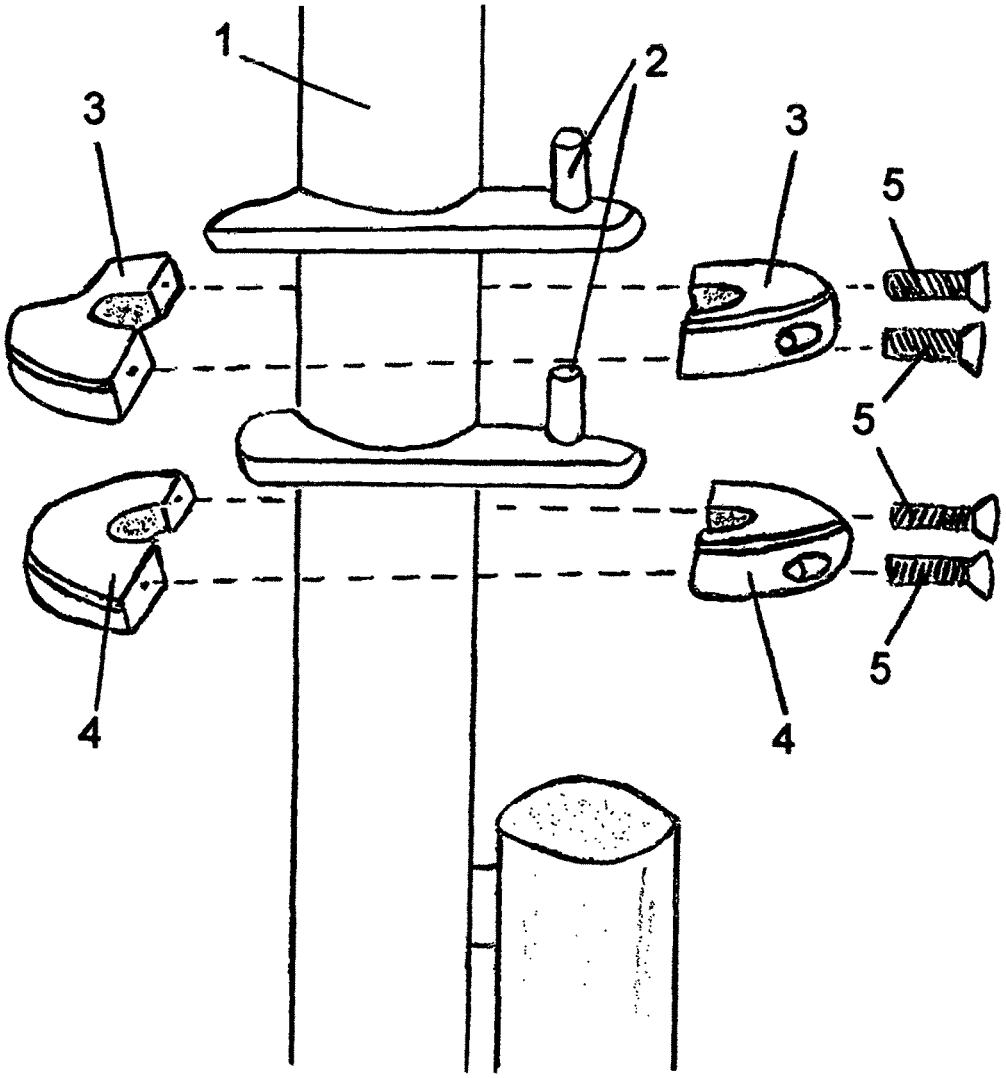
FIG. 1 shows an exploded view of the Wheelchair Injury-Prevention Guard as it looks in its accessory form and its location in relation to one side of a wheelchair's mainframe at the leg-rest attachment area.
Figure 2:
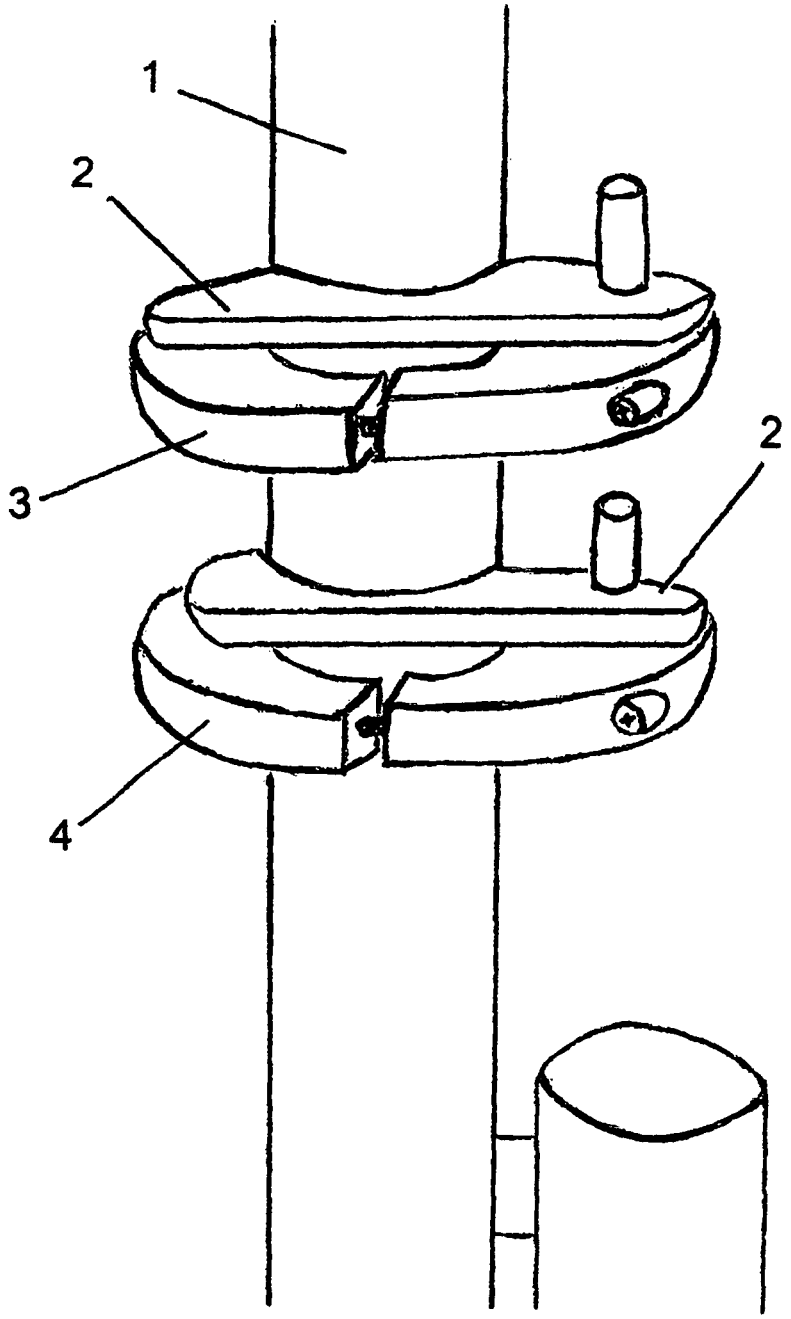
FIG. 2 shows the Wheelchair Injury-Prevention Guard mounted to one side of a wheelchair's mainframe at the leg-rest attachment area.
Figure 3:
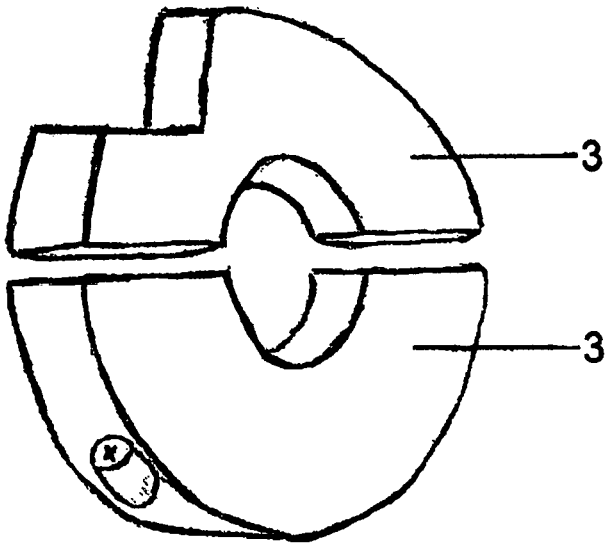
FIGS. 3 and 4 shows the design of the Wheelchair Injury-Prevention Guard as a set with a relieved area on part number 3 to allow for the leg-rest to lock into place when attached to the wheelchair.
Figure 4:
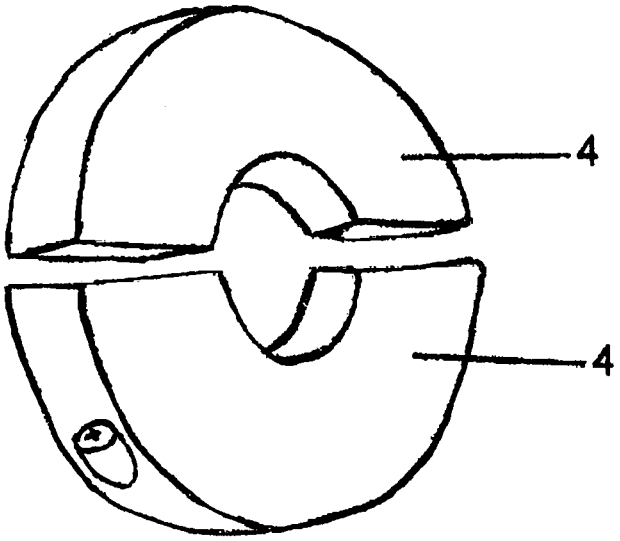
Figure 5:
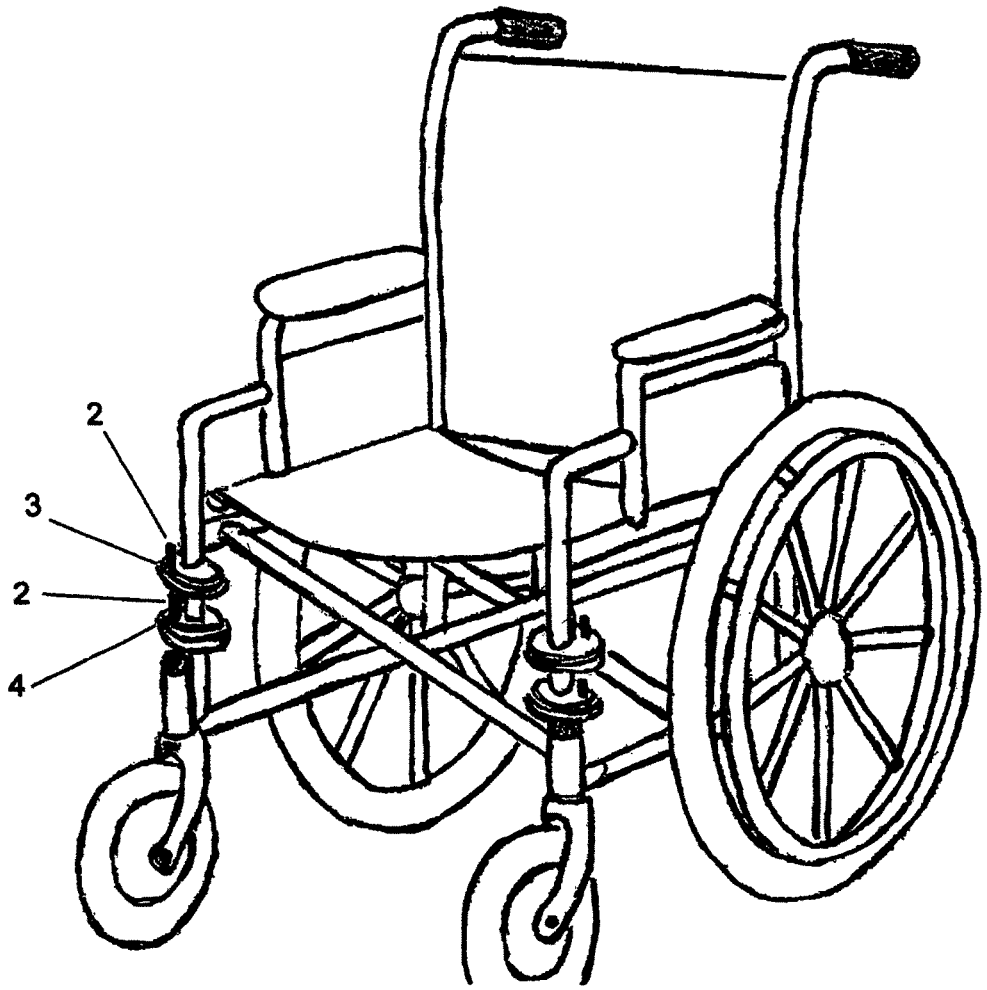
FIG. 5 illustrates the location of the guards on a manual wheelchair.
Figure 6:
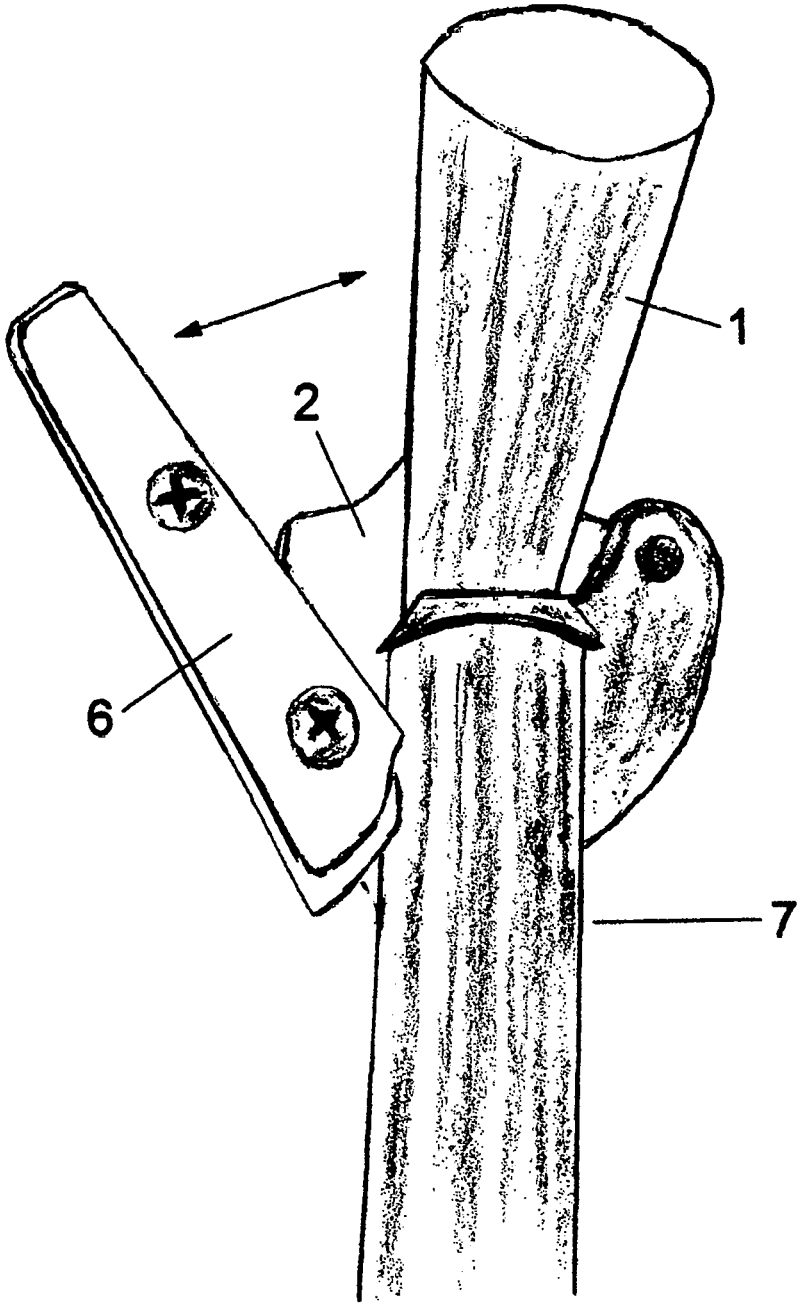
FIG. 6 illustrates how a leg-rest attaches and locks in place at the mainframe leg-rest attachment area

1 Wheelchair Mainframe
2 Mainframe Leg-rest Attachment
3 Protective Collar with Relieved Area
4 Protective Collar
5 Flat-head Screws
6 Leg-Rest Locking Arm
7 Leg-Rest

DETAILED DESCRIPTION

Referring to several of the views, the Injury-Prevention Guard invention is indicated as the combination of protective collar with Relieved Area 3 and the protective collar 4. Protective collar 3 is attached to each side of the wheelchair in-between the upper and lower leg-rest attachment 2 at a location as to not impede with the operation of the leg-rests. This includes strategically locating the relieved area of the protective collar 3 to allow for the leg-rest locking arm 6 to lock into place on the upper leg-rest attachment 2. Protective collar 4 is located immediately below the lower leg-rest attachment 2. Both protective collars 3 and 4 are locked into place using flat-head screws 5.

Once installed correctly, the protective collars 3 and 4 extend horizontally beyond the dangerously exposed mainframe leg-rest attachments 2, thus preventing a laceration injury to a wheelchair user by preventing contact with mainframe leg-rest attachments 2. Installed correctly, caregivers are able to remove and install a wheelchair's leg-rests quickly and easily.

The artwork being submitted portrays the Injury-Prevention Guard invention as being an accessory that is strategically attached to a wheelchair at the leg-rest attachment area. However, the invention could also be incorporated into the manufacturing of a new wheelchair.

The invention claimed is:

1. A protective device attached to a wheelchair comprising:

a wheelchair including a main frame;

a pair of mainframe leg rest attachments attached to the main frame;

a pair of injury protection guards each attached to the main frame fully below a respective leg rest attachment;

each injury protection guard comprising a pair of protective collars having a relieved area, each pair of protective collars being attached to one another with screws.

* * * * *